US007070548B2

(12) United States Patent
Thonn, Jr.

(10) Patent No.: US 7,070,548 B2
(45) Date of Patent: Jul. 4, 2006

(54) LEAN ABS MACHINE

(76) Inventor: Lawrence W. Thonn, Jr., P.O. Box 4, Chalmette, LA (US) 70044

( * ) Notice: Subject to any disclaimer, the term of this patent is extended or adjusted under 35 U.S.C. 154(b) by 38 days.

(21) Appl. No.: 10/417,483

(22) Filed: Apr. 17, 2003

(65) Prior Publication Data

US 2004/0209751 A1 Oct. 21, 2004

(51) Int. Cl.
*A63B 21/00* (2006.01)

(52) U.S. Cl. ..... 482/142; 482/140; 482/137

(58) Field of Classification Search ..... 482/142, 482/140, 141, 130, 104–109, 137, 95, 96, 482/97, 72, 100
See application file for complete search history.

(56) References Cited

U.S. PATENT DOCUMENTS 5,284,464 A * 2/1994 Lee et al. ..... 482/121
5,957,817 A * 9/1999 Koenig et al. ..... 482/72
6,270,447 B1 * 8/2001 La Placa ..... 482/100
6,312,365 B1 * 11/2001 Koenig ..... 482/97
6,712,744 B1 * 3/2004 Buechel et al. ..... 482/142

* cited by examiner

*Primary Examiner*—Jerome Donnelly

(57) ABSTRACT

An exercise machine has a motion arm with a handle between waist and chest height used by an exerciser in a standing position. Pushing the motion arm and leaning forward in a straight body position stretches the abs. Pulling the motion arm and leaning back to the straight standing position contracts the abs. A base may have a foot platform. The motion arm is connected to a lower or upper motion arm support by a pivot, roller or slider. Stretch cords or weights with lines, such as cables or belts, and pulleys attached to the motion arm assist or resist the movements. A chest support may also be used movably connected to the motion arm. Rollers may be used under a motion arm support.

20 Claims, 11 Drawing Sheets

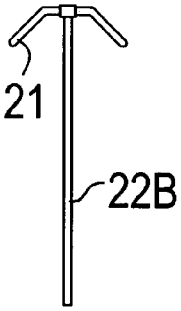
FIG. 1A
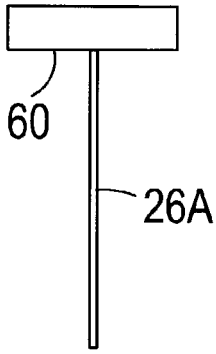
FIG. 1B
FIG. 1C
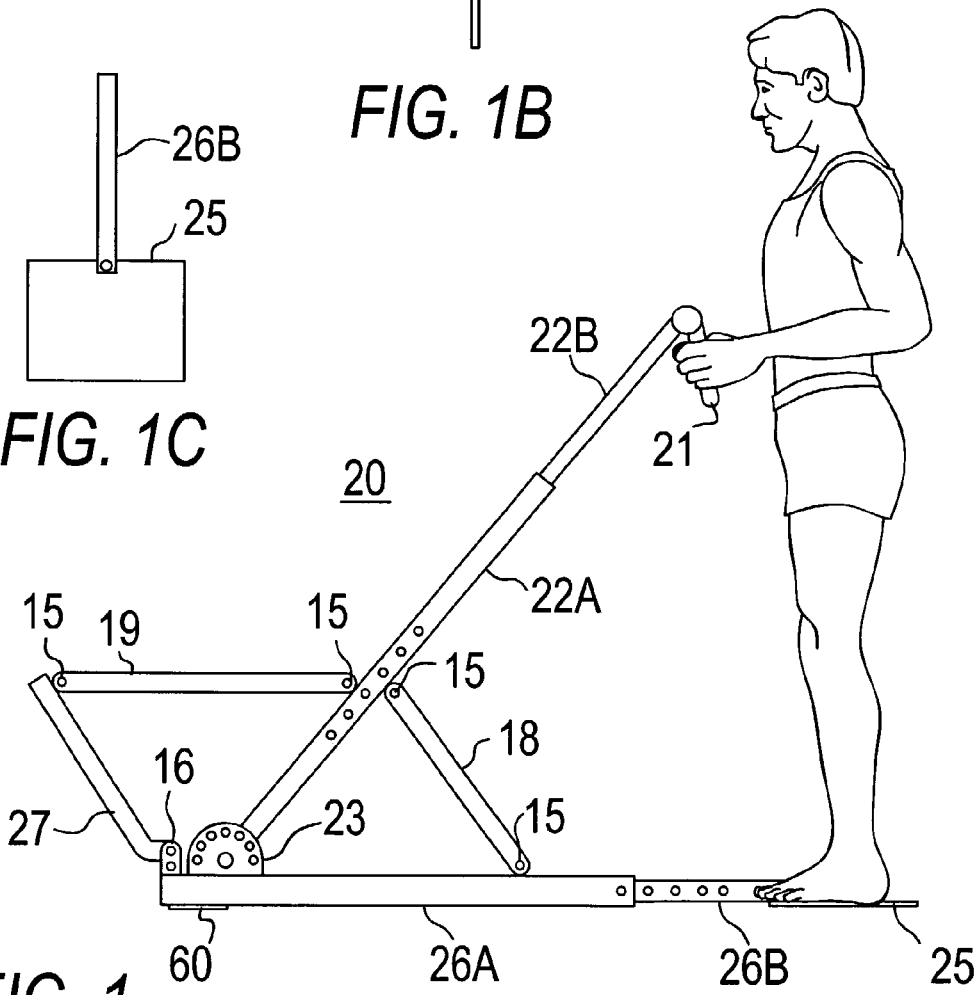
FIG. 1

LEAN ABS MACHINE

BACKGROUND OF THE INVENTION

1. Field of the Invention

The present invention relates to exercise apparatus, and more specifically, to an exercise machine which facilitates exercise of a person's abdominal muscles while accommodating the person in a standing position.

2. Description of the Prior Art

As with most major muscle groups, a wide variety of exercise apparatuses have been developed to specifically exercise the abdominal muscles of a user. The apparatuses generally require that the exerciser adjust a rather cumbersome user support and/or user interface member, sit upon the user support, secure any belts associated with the user support and engage the user interface member, before proceeding with a desired exercise routine.

Prior art U.S. Pat. No. 3,920,240, issued Nov. 18, 1975 to Ross, provides an exercise frame adapted to be stood on a floor and leaned against a wall and be supported thereby, which frame includes laterally offset side rails adapted to be gripped by a person exercising on the frame. A foot support board near a lower end of the frame is secured to the side rails to provide a surface upon which the person exercising with the frame may stand. A cross brace is connected to the side rails near the upper end of the frame to add strength and rigidity thereto. The space circumscribed by the side rails, foot support board and the cross brace is free of obstructions to permit freedom movement of one exercising on the frame.

Prior art U.S. Pat. No. 6,422,980, issued Jul. 23, 2002 to Simonson, describes an exercise apparatus that includes a base structure having a central support member with a first end and a second end to which a vertically oriented resistance assembly is secured. The apparatus also includes a cable having a first strand and a second strand. The cable links a user to the resistance assembly for the application of resistance as the user moves through an exercise routine. The first and second strands exit the resistance assembly at a position adjacent an upper end of the resistance assembly for engagement by the user at a position above the shoulders of the user. The apparatus further includes a user support structure having an upwardly extending support post. The support post includes a first end secured to the central support member and a second end. The support post further includes a rearward side facing away from the weight stack upon which is mounted a user support pad shaped and dimensioned for supporting a user's back as the user stands facing away from the resistance during an exercise routine. A family of exercise apparatuses is also disclosed.

Prior art U.S. Pat. No. 4,387,893, issued Jun. 14, 1983 to Baldwin, puts forth an exercising apparatus in which the body is supported while being restricted to rotary movement of upper and lower torso portions one relative to the other. Restriction of movement isolates the abdominal muscle group while accomplishing "full range" exercise as herein defined. The apparatus includes an upper torso engaging backrest and a lower torso engaging backrest and seat so that the user is supported in a generally seated position. Weights and a variable cam provide a variable resistance force to pivotal movement when the upper torso engaging backrest and the lower torso engaging backrest and seat are moved toward and away from each other.

Prior art U.S. Pat. No. 6,485,400, issued Nov. 26, 2002 to Serlachius, illustrates an apparatus for exercising the back and abdominal muscles, that includes an elongated beam and at least two spaced devices for transferring forces between the beam and its user. The preferred embodiment includes a lower crossbar for transmitting force from the beam to the user's shins or calves and a pad for transmitting force from the beam to the user's back or stomach. It also includes an upper crossbar and shoulder straps for transmitting force from the user's shoulders to the beam. An alternate embodiment includes an arcuate, laminated beam member in which the flexibility in bending is adjustable. It also includes a lower crossbar attachable to the user's ankles by means of a pair of ankle straps and an upper crossbar attachable to the shoulders with a pair of shoulder straps. When the alternate embodiment is in use, the central portion of the beam, which is preferably padded, contacts the user's back or stomach, transmitting force thereto.

Prior art U.S. Patent Application #20020039954, published Apr. 4, 2002 by Simonson, claims an exercise apparatus that comprises a base structure having a central support member with a first end and a second end to which a vertically oriented resistance assembly is secured. The apparatus also includes a cable having a first strand and a second strand. The cable links a user to the resistance assembly for the application of resistance as the user moves through an exercise routine. The first and second strands exit the resistance assembly at a position adjacent an upper end of the resistance assembly for engagement by the user at a position above the shoulders of the user. The apparatus further includes a user support structure having an upwardly extending support post. The support post includes a first end secured to the central support member and a second end. The support post further includes a rearward side facing away from the weight stack upon which is mounted a user support pad shaped and dimensioned for supporting a user's back as the user stands facing away from the resistance during an exercise routine. A family of exercise apparatuses is also disclosed.

Prior art U.S. Patent Application #20020032106, published Mar. 14, 2002 by Heiniemi, describes the Tummy Twister which is essentially a long metal tube with a protracted "S" shape. Near the bottom is a small bend that curves away from the user; near the top is a larger longer bend that curves toward the user. At the top is a pair of handle grips that extend out perpendicularly from the tube. Tummy Twister comes with a plastic water weight container that will hold 7 lbs. of water. While the user stands erect, holding on to the hand grips and twists his upper torso, the weight provides resistance and the angle of the curves in the tube concentrates the effect, thereby strengthening abs and oblique-in other words the stomach and waistline.

Prior art U.S. Pat. No. 5,779,987, issued Jul. 14, 1998 to Huang, is for an abdomen training device that comprises a base frame and carrying a positioning frame, with a support being mounted on the positioning frame. The device also includes and an abdomen training element, mounted on the support and further comprises an accommodating part, a spring, inserted into the accommodating part close to the front end thereof. The device also had a gliding bar, inserted into the accommodating part, the front end of the gliding bar leaning against the rear end of the spring, the rear end of the gliding bar extending beyond the rear end of the accommodating part, the gliding bar gliding inside the accommodating part along the longitudinal axis, and a rest plate, attached to the rear end of the gliding bar, having a rear surface, which is pressed against by the abdomen of a user. The user by contracting her or his abdominal muscles, pushes the rest plate and the gliding bar towards the front end of the abdomen training element against an elastic force caused by the spring and subsequently, releasing her or his abdominal muscles, allows the rest plate to return.

A continuing need, therefore, exists for an improved abdominal exercise apparatus, which is easy and safe to use, relatively inexpensive, and more accessible to a wide range of exercisers.

SUMMARY OF THE INVENTION

An object of the present invention is to provide an exercise device for exercising the abdominal muscles, which has a stationary base support with a foot platform for an exerciser to stand on, thereby allowing a person to exercise beginning from the upright standing position.

A contributory object of the present invention is to provide a motion arm capable of pivoting, rolling or sliding away from the exerciser and when the exerciser leans forward pressing against the motion arm thereby stretching the exerciser's abdominal muscles and/or the obliques. Other muscles that receive secondary benefits are shoulders, arms and back.

Additionally the handle of the exerciser is capable of pivoting left or right 180 degrees as the exerciser leans forward and twist or stands to the left or to the right.

Another object of the present invention is to provide a means for assisting the exerciser in pulling the motion arm back to the starting position (towards the exerciser), thereby making it easier to use for beginners.

One more object of the present invention is to provide a means for resisting the exerciser in pulling the motion arm away from the exerciser for a more advanced workout.

A corollary object of the present invention is to provide an alternative set of weights to be used on the exerciser rather than tension members to add assistance or resistance for use in heavier use facilities.

An additional object of the present invention is to provide an improved abdominal exercise apparatus that is easy, convenient and safe to use.

A further object of the present invention is to provide abdominal exercisers made for home use that is relatively inexpensive and foldable, thereby more accessible to a wide range of exercisers.

An ensuing object of the present invention is to provide an alternate embodiment of the invention that has a chest support (to reduce back stress) with the exerciser set to begin.

An ancillary object of the present invention is to provide an alternate embodiment of the invention that has an adjustable secondary arm attached to the motion arm (which becomes fixed) and base, with an adjustable roller or slide track means.

In brief, an abdominal exercising machine which comprises a base, a foot plate located at the back of the base, a motion bar that may roll or slide within the upper or lower base frame or is pivotally attached to the upper or lower base frame and tension straps or weights to adjust the assisting or resisting tension. The exerciser holds a pair of handles located on the motion bar and pushes forward (allowing and causing the body to lean toward the front of the exerciser) stretching the abdominal muscles. Then the exerciser pulls the motion bar back (allowing and causing the body to return to the upright position) tightening the abdominal muscles.

An alternative embodiment is provided with a chest support (which reduces the pressure on the spine) and a tension strap or line, such as a cable or belt, with weights attached, run through pulleys, which can assist or resist (depending on which side of the motion bar the cable or belt end is connected to) the action of the exerciser pulling the motion bar back.

A further embodiment comprises a roller or sliding track means and a handle means that is attached to a roller, bearing or sliding means, which rolls or slides in the track means as the exerciser moves forward and back.

An advantage of the present invention is that it allows an exerciser to begin in a standing position.

Another advantage of present invention is that it is easy to use.

An additional advantage of present invention made for the home user is in being relatively inexpensive.

One more advantage of present invention is that it has adjustable assisting tension or weight means.

Yet another advantage of present invention is that it has adjustable resisting tension or weight means.

Still another advantage of present invention is the initial set up is very simple.

And finally another feature advantage of the models made for home use is that they are foldable for compact storage.

BRIEF DESCRIPTION OF THE DRAWINGS

These and other details of my invention will be described in connection with the accompanying drawings, which are furnished only by way of illustration and not in limitation of the invention, and in which drawings:

FIG. 1 is a side elevation diagrammatic view of the preferred embodiment of the invention with the exerciser set to begin;

FIG. 1A is a front elevation diagrammatic view of the top of the motion post and the handle of the preferred embodiment of the invention of FIG. 1;

FIG. 1B is a top plan diagrammatic view of the front of the base of the preferred embodiment of the invention of FIG. 1;

FIG. 1C is a top plan diagrammatic view of the back of the base of the preferred embodiment of the invention of FIG. 1 with the foot platform;

BEST MODE FOR CARRYING OUT THE INVENTION

Figure 2:
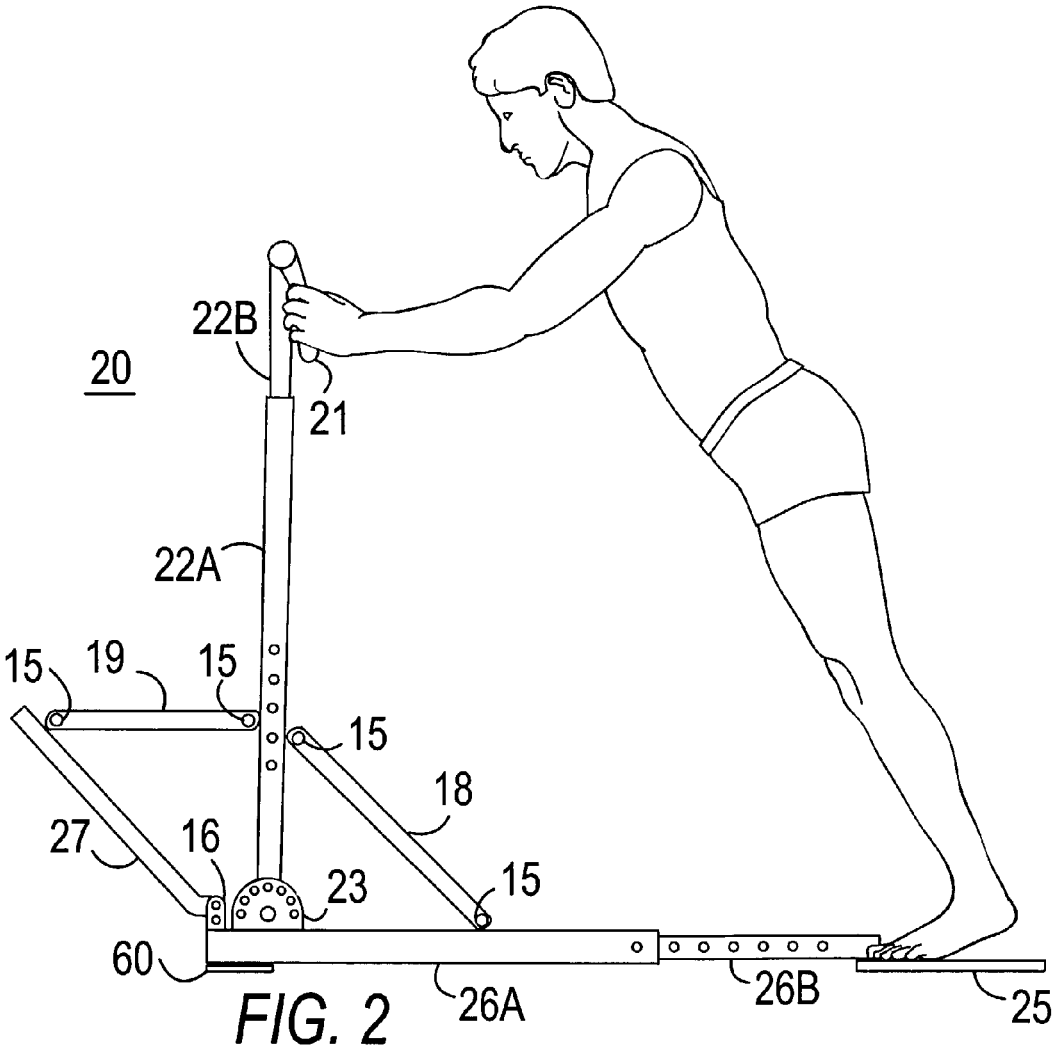
FIG. 2 is a side elevation diagrammatic view of the preferred embodiment of the invention of FIG. 1 with the exerciser in the leaning forward position.

In FIG. 1–11 an exercise device 20, and 20A–20F for exercising the abdominal muscles is shown.

In FIG. 1–4, the device 20 has a motion arm 22 attached to the base support 26 by a pivotal, roller or slide means 23. The motion arm 22 has a handle 21 means positioned so that the exerciser is able to grasp the handle means 21 with their arms at the waist level or with their elbows bent to start from the lower chest level. The exerciser stands on the foot platform 25 in an upright position, as shown in FIG. 1. The motion arm 22 is capable of pivoting away from the exerciser when the exerciser pushes against the motion arm 22 causing and allowing the body to lean forward thereby stretching the exerciser's abdominal muscles, as in FIG. 2. The motion arm 22 is capable of stopping at any point when the exerciser is leaning forward with arms extended, out (forward) and upward from the exerciser's body. The motion arm 22 is capable of pivoting toward the exerciser when the exerciser pulls the motion arm 22 back allowing and causing their body to return back to the upright standing position, thereby contracting the abdominal muscles of the exerciser. The motion arm 22 is adjustable in length by a telescoping means comprising telescoping tubes 22A and 22B. The device further comprises a telescoping means comprising telescoping tubes 26A and 26B (FIGS. 1–5, 8 & 11) to adjust the length of the base.

Figure 9:
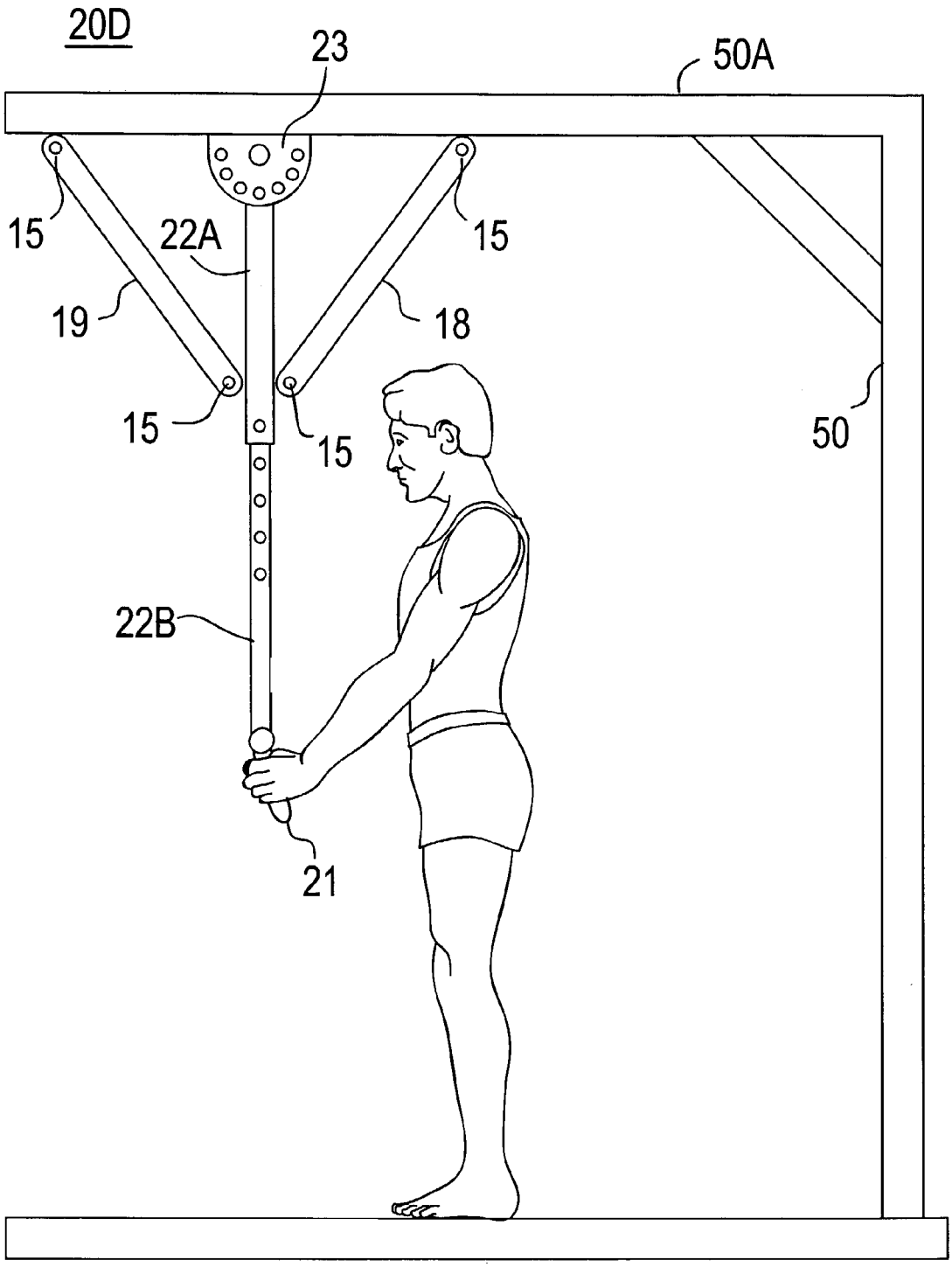
FIG. 9 is a side elevation diagrammatic view of a similar embodiment as the ones in FIGS. 1–4 and 8 except with the motion arm pivoting from the top of the frame to accomplish the same motion.
Figure 10:
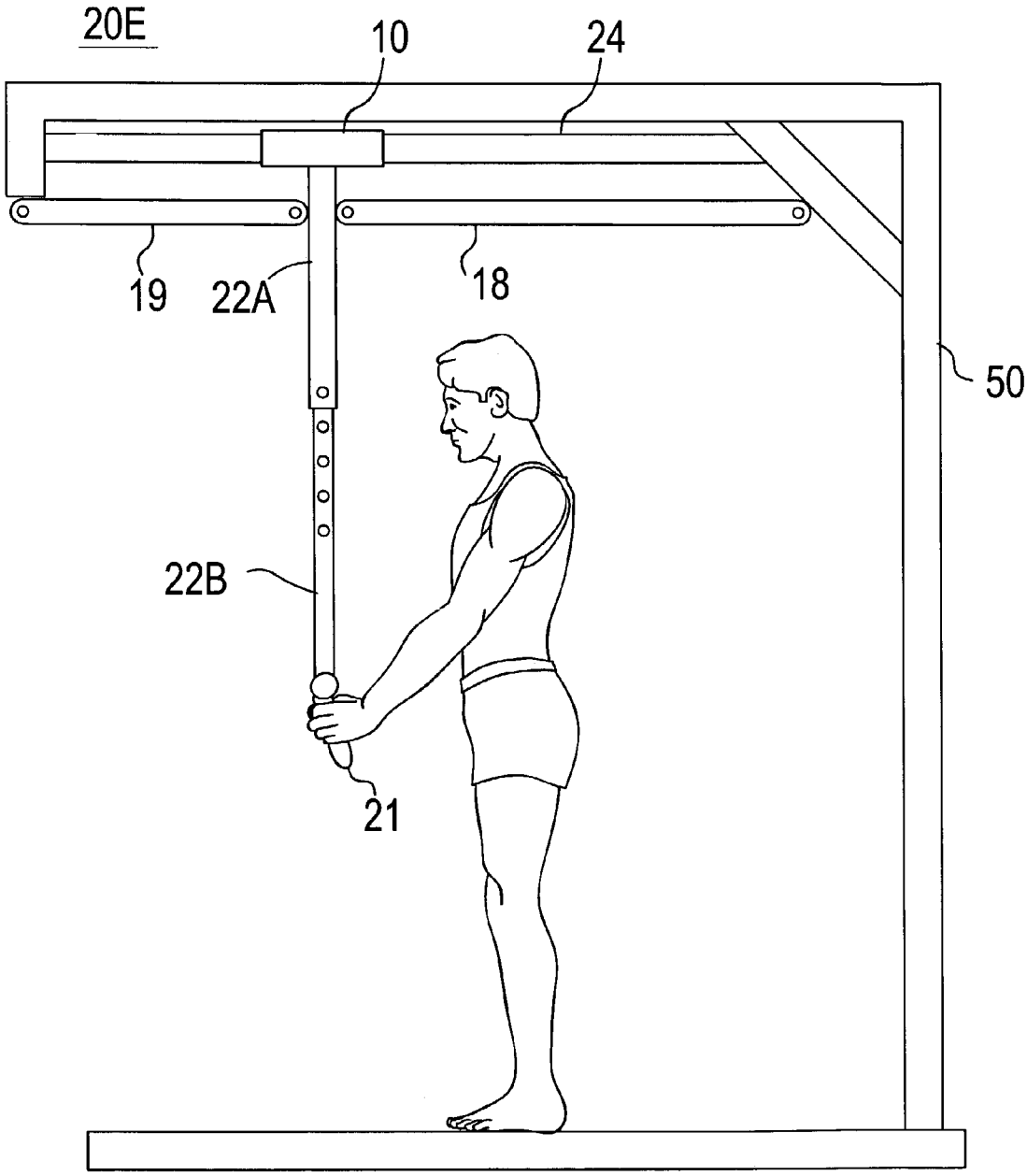
FIG. 10 is a side elevation diagrammatic view of a similar embodiment as the one in FIG. 6 except with the motion arm rolling or sliding from the top of the frame to accomplish the same motion.

The exerciser device 20 also may have a means for assisting and/or resisting the exerciser in pulling the motion arm 22. The assisting means, when used, comprises an assisting tension means 18, such as a rubberized loop or a bungee-type cord or spring means or other tension means, stretched between the motion arm 22 and the base support 26 in a position 15 on the base support 26A between the foot platform 25 and the motion arm 22. In FIGS. 9 and 10 the assist tension means is connected above the exerciser at point 15 on the frame 50. The resisting means, when used, comprises a tension means 19, such as a rubberized loop or a bungee-type cord or spring means or other tension means, stretched between the motion arm 22 and a bracket 15 means attached to the base support 26 in a position in front of the motion arm 22 (preferably on the front angled arm 27), away from the exerciser, so that the motion arm 22 is between the exerciser and the resisting tension means 19. In FIGS. 9 and 10 the resisting tension means is connected above the exerciser at point 15 on the frame 50. The assisting means is helpful for people just beginning to use the device, while the resisting means is helpful to increase the benefit of the device for people who have already done some work on their abs. Tension may be changed by changing the tension means to provide more or less tension with various thicknesses of rubber or by varying the connecting point positions.

Figure 3:
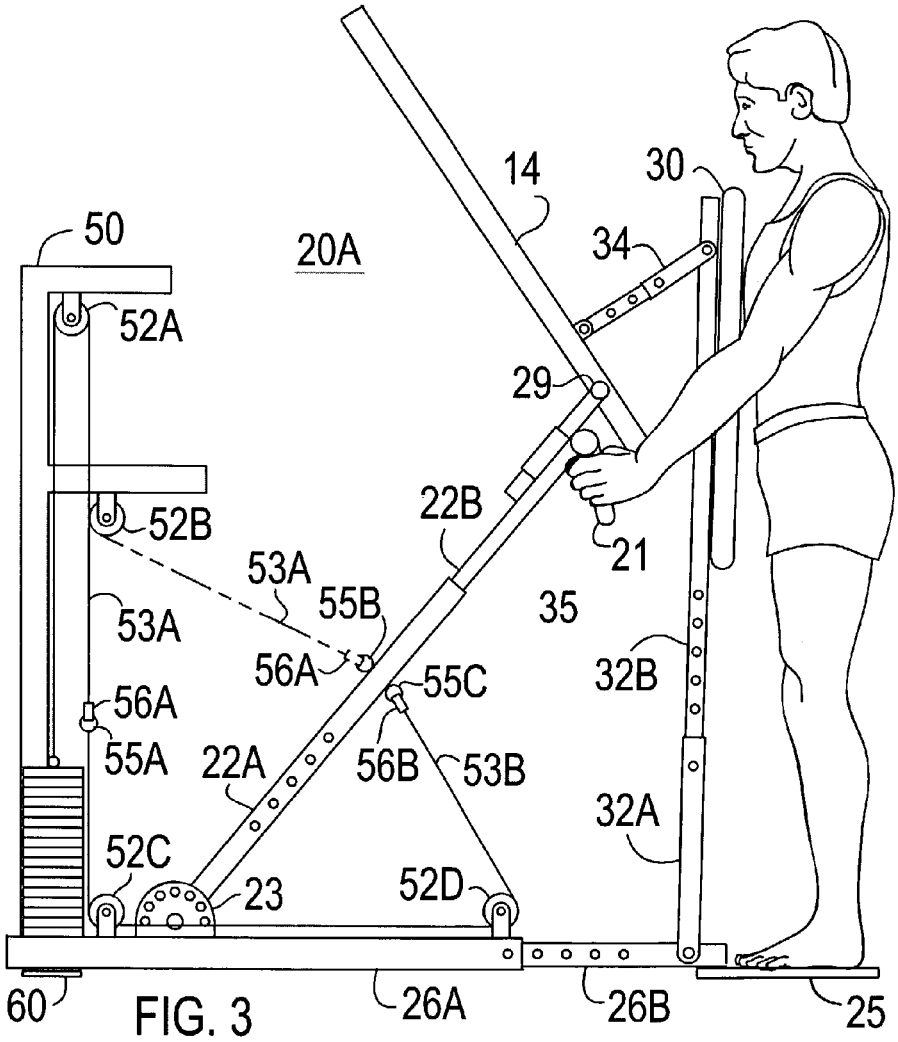
FIG. 3 is a side elevation diagrammatic view of an alternate embodiment of the invention having a chest support with the exerciser set to begin and an alternative set of weights mounted in the front of the exerciser rather than tension members to add assistance or resistance.

In FIG. 3, the exercise device 20A has an alternate means for resisting the exerciser in pulling the motion arm 22 back away from the exerciser. The assisting means comprises a support frame 50 for a line 53, such a cable or belt, and pulley 52A–52D system attached to a weight stack 51 at the end of the cable or belt 53B attached by a quick release mechanism 56B to the motion arm 22A through a pulley 52D on the base 26A to a loop 55C attached in a position 55 on the motion arm 22 facing toward the exerciser so that the cable or belt 53B is between the exerciser and the motion arm 22. The exercise device 20A also has an alternate means for resisting the exerciser in pulling the motion arm 22 away from the exerciser. The resisting means comprises a cable or belt 53A and pulley system 52A–52B attached to a weight stack 51 with an end of the cable or belt 53A released from the ring 55A on the cable or belt and attached at a ring 55B on the motion arm 22A using a quick release mechanism 56A on a side of the motion arm 22 away from the exerciser. The weight stack may also be configured to work from a position behind the exerciser by the addition of one pulley as pictured in FIG. 8.

Figure 4:
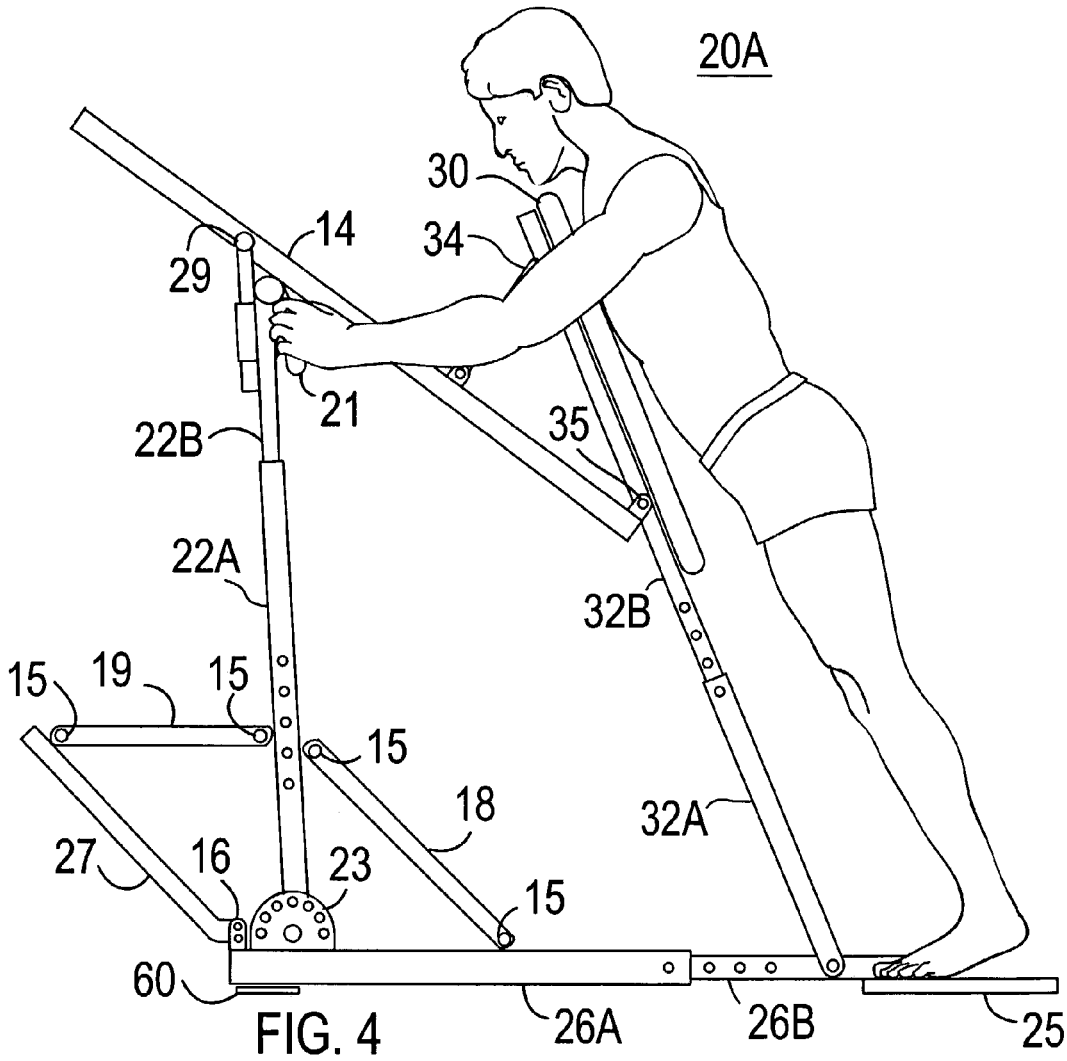
FIG. 4 is a side elevation diagrammatic view of the alternate embodiment of the invention of FIG. 3 having a chest support with the exerciser in the leaning forward position.

The exercise device 20A further comprising a chest support means 30 for receiving the chest of the exerciser when the exerciser leans forward, as shown in FIG. 4, and a roller, bearing or sliding means 29 rolling or sliding in a track 14 positioned between the motion arm 22 and the chest support means 30 with brackets 34 and 35 between the track and the chest support pad.

Figure 5:
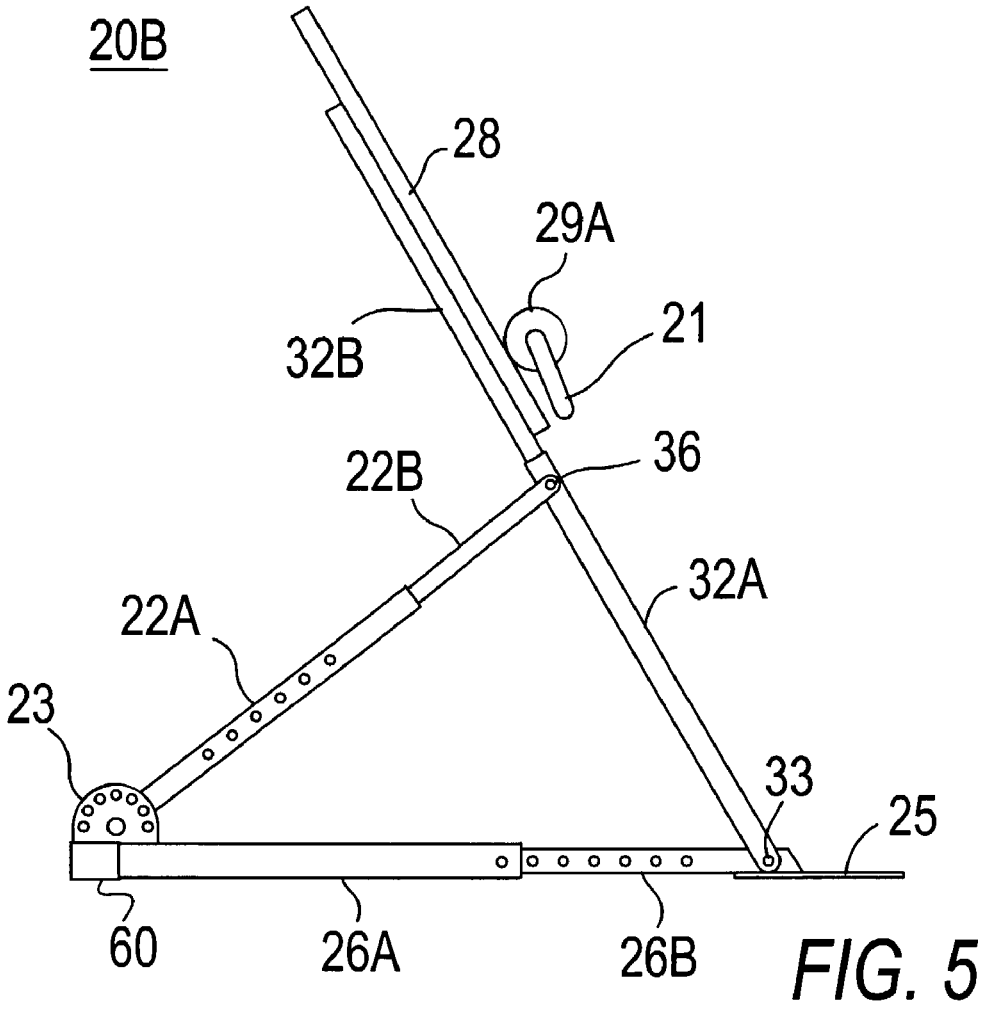
FIG. 5 is a side elevation diagrammatic view of an alternate embodiment of the invention having an adjustably elevated track on which a roller, bearing, or sliding arm mechanism rides.

In FIG. 5, another embodiment of the exercise device 20B is shown, which comprises a second arm 32 attached to an upper end of the adjustable angle support brace 22 by a pivotal means 36 and attached to the base support 26 by a pivotal means 33 at a point between the arm 22 and the exerciser. The second arm 32 comprises a roller track means 28 and a handle 21 means attached to a roller, bearing or slide means 29A which rolls or slides in the track means 28 as the exerciser moves forward and backward. The exercise device 20B may employ the same means for assisting and resisting the exerciser in pulling the motion arm 22 back as shown in the previous embodiments. The resistance angle for the degree of the forward lean is accomplished by adjusting the height of the arm 22 and the base 26 is adjusted to accommodate for the height of the user.

Figure 6:
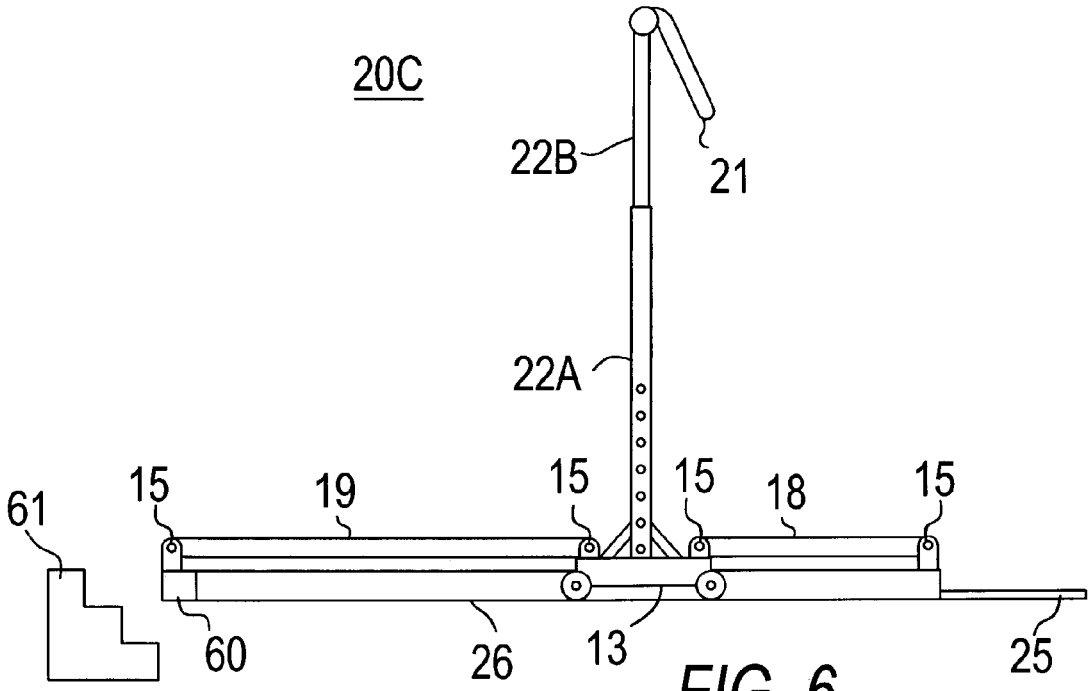
FIG. 6 is a side elevation diagrammatic view of an alternate embodiment of the invention with the motion arm mounted on or in a roller, bearing or sliding track.

In FIG. 6 another alternate embodiment of the exercise devise 20C is shown, which the base frame 26 is a roller bearing or slide track in which a movable carriage 13 rolls or slides forward or back between the footplate 25 and the front stabilizer brace 60. The exercise devise 20C also may have a means for assisting and/or resisting the exerciser by pulling the motion arm 22 back towards the starting position or away from the exerciser. The assisting means, when used, comprises an assisting tension means 18, such as a rubberized loop or a bungee-type cord or spring type or other tension means, stretched in a position 15 on the base track 26 between the foot platform and the movable carriage 13. The resisting means, when used, comprises a tension means 19, such as a rubberized loop or a bungee-type cord or spring type or other tension means, stretched from a bracket 15 on or near the stabilizer brace 60 to another bracket 15 on the front of the movable carriage 13. An alternate method of assisting or resisting the exerciser also may be accomplished with the exerciser 20C in FIG. 6 by lifting up the front or back of the exercise devise with multi-level block 61 or by other jacking means. Assisting means lifting up the front of the exercise devise so that the gravitational pull is toward the exerciser and resisting means lifting up the rear of the exercise devise so that the gravitational pull is away from the exerciser.

Figure 7:
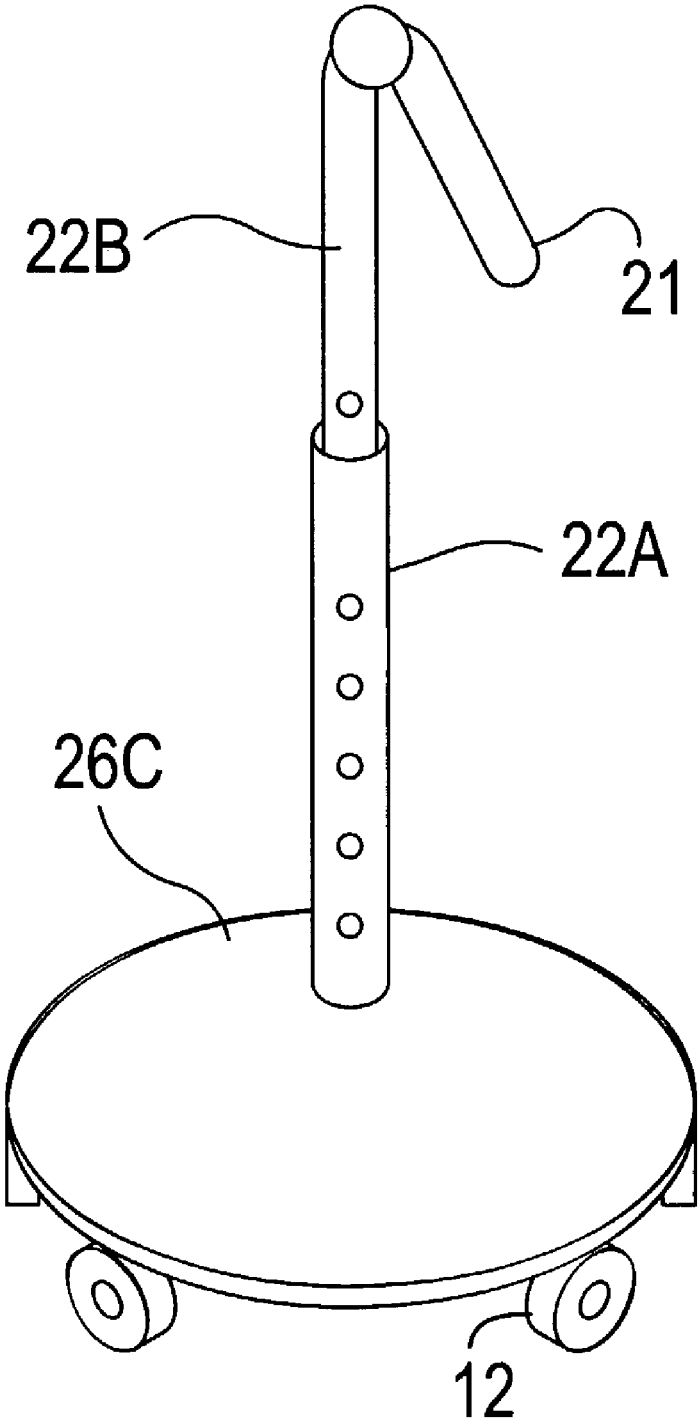
FIG. 7 is a side elevation diagrammatic view of an alternate embodiment of the invention with the motion arm mounted on a larger roller base so that no frame or footplate is necessary.

In FIG. 7 another embodiment of the present invention is pictured in which the movable carriage 26C is larger and forms a movable base mounted on wheels 12 eliminating the need for a roller or sliding track and footplate as in FIG. 6.

Figure 8:
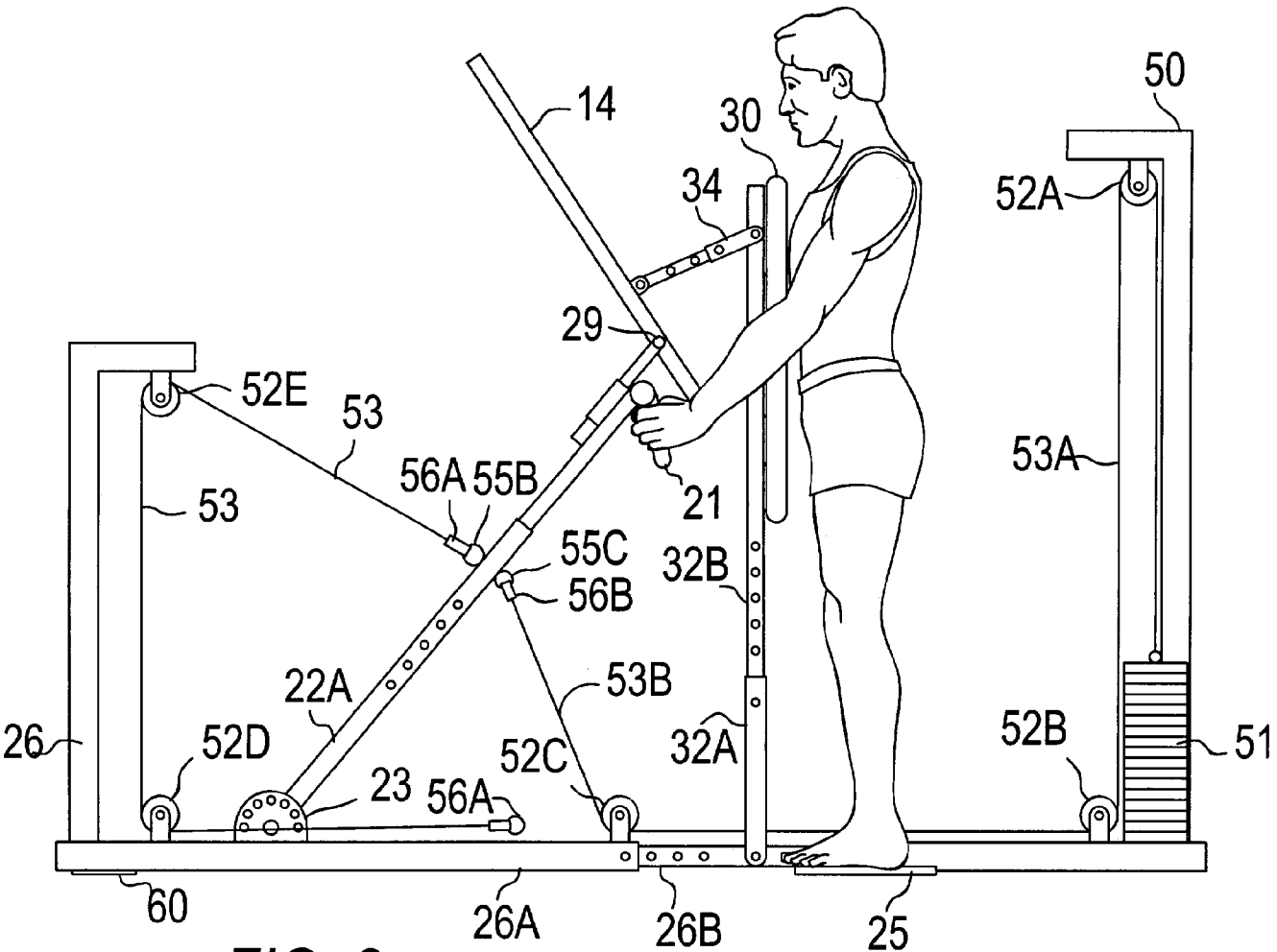
FIG. 8 is a side elevation diagrammatic view of the alternate embodiment of the invention of FIG. 3 having a chest support with the exerciser set to begin and an alternative set of weights mounted in the rear of the exerciser rather than tension members to add assistance or resistance.

In FIG. 8 the exercise devise has an alternate means for assisting or resisting the exerciser in pulling the motion arm toward or away from the exerciser. The assisting means comprises a support frame 50 for a line 53, such as a cable or belt, and a pulley system 52A–52C attached to a weight stack means 51 with and end of the cable or belt 53B attached by a quick release mechanism 56B to the motion arm 22 through a pulley 52C on the base of the 26A to a loop 55C attached in a position 55 on the motion arm 22 facing toward the exerciser so that the cable or belt 53B is between the exerciser and the motion arm 22. The exercise device 20A in FIG. 8 also has an alternate means for resisting the exerciser in pulling the motion arm 22 away for the exerciser. The resisting means comprises a cable or belt 53A and pulley system 52A–52E attached to a weight stack means 51 with and end of the cable or belt 53A released from the ring 55C and the cable or belt end 56B attached to the cable or belt at 56A and the end of cable or belt 53C is routed through pulleys 52D–52E and attached to ring 55B at a position on the front side of the motion arm 22 with a quick release devise 56A.

In FIG. 9 another embodiment of the exercise devise is shown 20D in which the motion arm 22 pivots at a position 23 on the upper frame 50A and also incorporates the similar methods of assisting or resisting the exerciser as the before mentioned exercise machines FIGS. 1, 2 and 4 with the exception that the assisting or resisting tension devise is connected to the back (for resisting) or front (for assisting) the motion arm 22 and the upper frame 50A at position 15.

In FIG. 10 another embodiment of the exercise devise 20E is shown in which the motion arm 22, with adjustable telescoping portions 22A and 22B, has a roller or slider housing 10 which moves along the guide tube 24 near the upper frame 50A and also incorporates the similar methods of assisting or resisting the exerciser as the before mentioned exercise machines FIGS. 1, 2 and 4.

Figure 11:
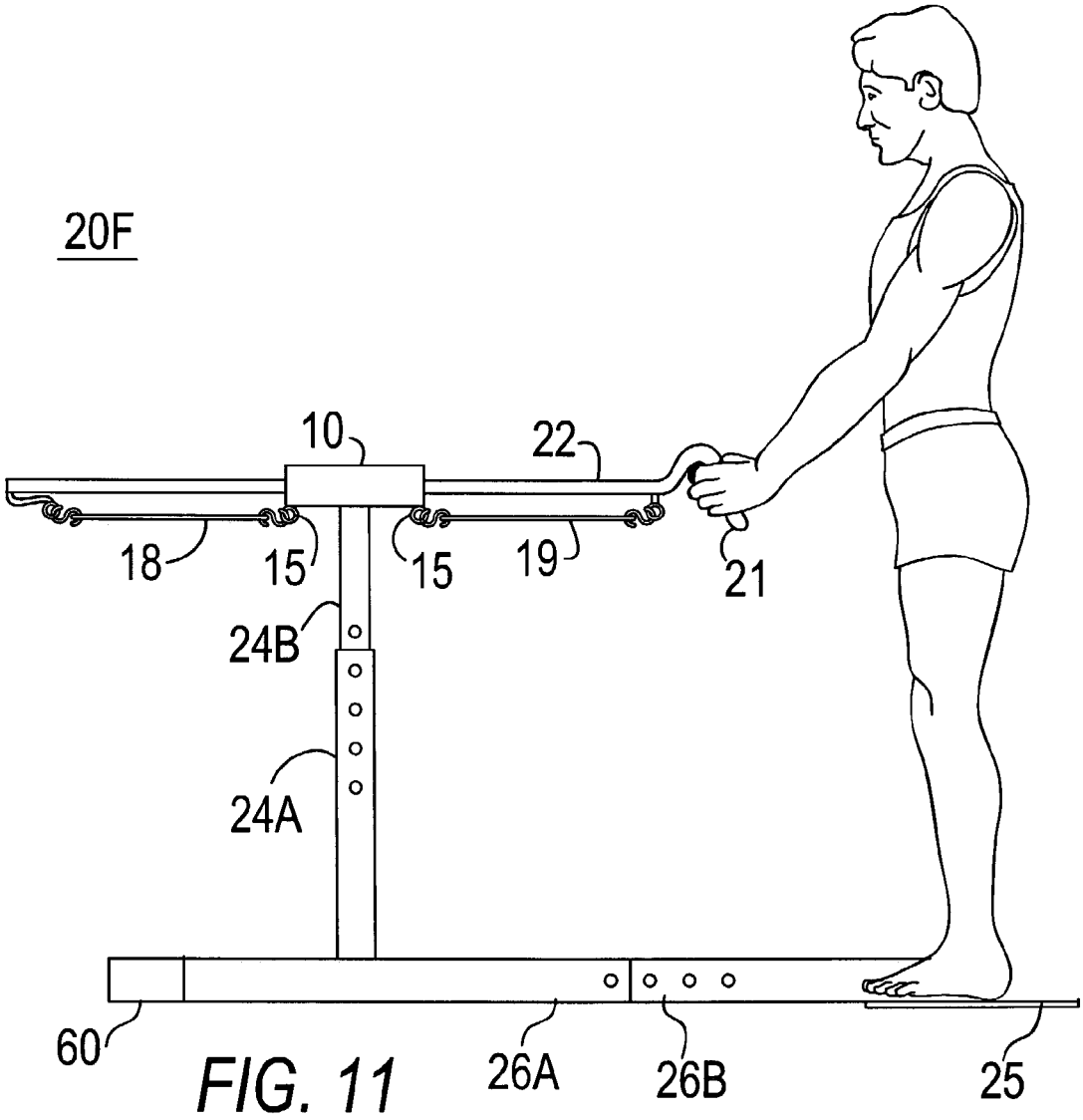
FIG. 11 is a side elevation diagrammatic of an alternate embodiment of the exerciser 20F with the motion arm 22 positioned horizontally with the ability to move in and out through a roller, bearing or slide housing 23

In FIG. 11 another alternate embodiment of the exerciser 20F is shown where the exerciser stands on the footplate 25 and holds the handles 21 connected to the motion arm 22 positioned horizontally and is capable of rolling or sliding forward or backwards through the roller, bearing or slide housing 10. As in all of the before mentioned exercise devises the exerciser pushes the motion bar 22 causing and allowing their body to lean forward while stretching the abdominal muscles. The motion bar 22 is capable of stopping at any point during the leaning process and reversing the motion when the exerciser pulls the motion arm 22 back allowing and causing their body to return back to the upright standing position, thereby contracting the abdominal muscles of the exerciser. The exerciser device 20F also may have a means for assisting and/or resisting the exerciser in pulling the motion arm 22. The assisting means, when used, comprises an assisting tension means 18, such as a rubberized loop or a bungee-type cord or spring means or other tension means, stretched between the far end of the motion arm 22 and the far end of the roller, bearing or slide housing 10 to a bracket 15. The resisting means, when used, comprises a resisting tension means 19, such as a rubberized loop or a bungee-type cord or spring means or other tension means, stretched between the handle 21 end of the motion arm 22 and the roller, bearing or slide housing 10 to a bracket 15. The exercise devise 20F has and adjustable roller, bearing or slide housing support 24 with telescoping portions 24A and 24B and an adjustable base 26 with telescoping portions 26A and 26B to vary the height and degree of the angle for the varying heights of the exercisers.

In practice, the exerciser setting up for use of the preferred embodiment 20 would adjust the motion arm 22 to fit their requirements by sliding the inner motion tube 22B in or out of the outer motion tube 22A until the desired height was met, then inserting a pin into the holes located on the outer motion tube 22A and the inner motion tube 22A. The telescoping outer tube 26A and the telescoping inner tube 26B of the base 26 would likewise be adjusted to accommodate the height of the exerciser. Next, the exerciser would set up the amount of tension they require by installing either the reverse tension band 19 for more resistance, or the assisting tension band 18 for help in replacing the motion arm 22 to the upright position, shown in FIG. 1. The exerciser would then place his/her feet on the foot plate 25 or on the floor as shown in FIG. 7, hold a pair of handles 21 connected to the motion bar 22 and push the motion bar 22 causing and allowing their body to lean forward while stretching the abdominal muscles, as shown in FIG. 2. The exerciser then pulls back the motion bar 22 tightening the abdominal muscles and causing and allowing the body to return to the upright standing position, as shown in FIG. 1.

In practice, an alternative embodiment 20A shown in FIGS. 3 and 4, would require the same setup of the motion arm 22 and base 26, but would also require similar setup of the telescoping outer tube 32A and the inner telescoping tube 32B of the chest support 32. An adjustable bracket 34 located between the chest support 32 and the roller or slide track 14 would also need to be adjusted to meet the user's needs. A tension band 18 or 19 would need to be inserted into the hooks 15 to provide assisting or resisting tension, depending on which side of the motion bar it is on. In embodiment 20A the user would put their chest against the chest support pad 30, with their feet on the adjustable foot plate 25, hold a pair of handles 21 at the top of the motion bar 22, and pushes the motion bar 22 causing and allowing their body to lean forward while stretching the abdominal muscles, as shown in FIG. 4. The exerciser then pulls back the motion bar 22 tightening the abdominal muscles and causing and allowing the body to return to the upright standing position, as shown in FIG. 3. Weights 51 can be attached to a line 53, such as a cable or belt, the cable or belt 53 run through pulleys 52A–52D and attached to a hook 54, thereby assisting in pulling the motion bar 22 back to an upright position. To add resistance against pulling the motion bar 22 back to an upright position the cable or belt 53 needs to be run through pulleys 52A and 52B and attached to a hook 55.

In practice, another alternate embodiment 20B, shown in FIG. 5, would require the same setup of the arm 22 (which becomes fixed) and base 26, but would also require similar setup of the telescoping outer tube 32A and the inner telescoping tube 32B which supports the roller or slide track 14. The user could hook one end of the tension bands 18 and 19 to the roller 29A. The other end of the assisting tension band 18 would be hooked 15 below the roller 29A for an easier workout, or the other end of the resisting tension band 19 would be hooked 15 above the roller 29A to provide a more strenuous workout. The user would then place their feet on the foot plate 25, hold a pair of handles 21 and move the roller, bearing or slide 29A along the roller or slide track 14.

In all of the embodiments, 20, and 20A through 20F, a more strenuous workout is obtained by increasing the angle of the user lean from the upright position, which is determined by the length of the motion arm 22 or by the angle of the arm 32 in FIG. 5.

It is understood that the preceding description is given merely by way of illustration and not in limitation of the invention and that various modifications may be made thereto without departing from the spirit of the invention as claimed.

What is claimed is:

1. An exercise device for exercising the abdominal muscles, the device comprising:

a motion arm on a support means, the motion arm spaced apart from an exerciser in a standing position, the motion arm having a handle means configured so that an exerciser is able to grasp the handle means at waist or chest level with the exerciser's arm straight or with elbows bent and the exerciser standing in a straight upright position, the motion arm capable of being moved away from the exerciser when the exerciser pushes out on the motion arm causing and allowing the exerciser's body to lean forward while maintaining a straight body position bending at the ankles with the heels slightly elevated, thereby stretching the abdominal muscles, the motion arm being capable of stopping when the exerciser is leaning forward with arms extended out and up from the exerciser's body still held in a straight body position, and the motion arm being capable of returning toward the exerciser when the exerciser pulls back the motion bar causing and allowing the body still held in a straight body position to return to the upright standing position, thereby tightening the abdominal muscles, and a chest support means for receiving the chest of the exerciser when the exerciser leans forward and further comprising a roller means between the motion arm and a roller track means attached to the chest support means.

2. The exercise device of claim 1 further comprising:

a stationary support having a foot platform for an exerciser to stand on and a motion arm support;

and further comprising a means for connecting the motion arm to the motion arm support selected from the list of means including a pivoting means, a bearing means, a roller means and a sliding means.

3. The exercise device of claim 2 wherein the motion arm support comprises a lower base support.

4. The exercise device of claim 2 wherein the motion arm support comprises an upper support.

5. The exercise device of claim 2 further comprising a means for assisting the exerciser in pulling the motion arm toward the exerciser.

6. The exercise device of claim 5 wherein the means for assisting the exerciser in pulling the motion arm towards the exerciser in the start position comprises an assisting tension means stretched between the motion arm and the motion arm support between the motion arm and the exerciser.

7. The exercise device of claim 5 wherein the means for assisting the exerciser in pulling the motion arm towards the exerciser comprises a line and pulley system attached to a weight means with an end of the line attached to the motion arm between the motion arm and the exerciser.

8. The exercise device of claim 2 further comprising a means for resisting the exerciser in pushing the motion arm away from the exerciser.

9. The exercise device of claim 8 wherein the means for resisting the exerciser in pushing the motion arm away from the exerciser comprises a tension means stretched between the motion arm and the motion arm support in a position in front of the motion arm away from the exerciser so that the motion arm is between the exerciser and the resisting tension means.

10. The exercise device of claim 8 wherein the means for resisting the exerciser in pulling the motion arm away from the exerciser comprises a line and pulley system attached to a weight means with an end of the line attached to the motion arm through a pulley on the motion arm support in a position in front of the motion arm away from the exerciser so that the motion arm is between the exerciser and the line and pulley system.

11. An exercise device for exercising the abdominal muscles, the device comprising:

a motion arm on a support means, the motion arm spaced apart from an exerciser in a standing position, the motion arm having a handle means configured so that an exerciser is able to grasp the handle means at waist or chest level with the exerciser's arm straight or with elbows bent and the exerciser standing in a straight upright position, the motion arm capable of being moved away from the exerciser when the exerciser pushes out on the motion arm causing and allowing the exerciser's body to lean forward while maintaining a straight body position bending at the ankles with the heels slightly elevated, thereby stretching the abdominal muscles, the motion arm being capable of stopping when the exerciser is leaning forward with arms extended out and up from the exerciser's body still held in a straight body position, and the motion arm being capable of returning toward the exerciser when the exerciser pulls back the motion bar causing and allowing the body still held in a straight body position to return to the upright standing position, thereby tightening the abdominal muscles;

a stationary support having a foot platform for an exerciser to stand on and a motion arm support;

a means for connecting the motion arm to the motion arm support selected from the list of means including a pivoting means, a bearing means, a roller means and a sliding means; and a pivotal adjustable support arm attached to a second adjustable track arm that is attached to the motion arm support by a pivotal means at a point between the motion arm and the exerciser, wherein the adjustable track arm comprises a track means and the handle means is attached to a low friction motion means which moves in the track means as the exerciser moves forward and back.

12. The exercise device of claim 11 further comprising a chest support means for receiving the chest of the exerciser when the exerciser leans forward and further comprising a roller means between the motion arm and a roller track means attached to the chest support means.

13. The exercise device of claim 1 wherein the motion arm is adjustable in length by a telescoping means.

14. The exercise device of claim 1 wherein the motion arm support is adjustable in length by a telescoping means.

15. The exercise device of claim 1 wherein the motion arm support further comprises lower rollers for moving on an external surface.

16. The exercise device of claim 11 wherein the low friction motion means comprises a motion means selected from a list of motion means including a roller, a bearing and a slide means.

17. The exercise device of claim 11 further comprising a means for assisting the exerciser in pulling the motion arm towards the exerciser.

18. The exercise device of claim 17 wherein the means for assisting the exerciser in pulling the motion arm towards the exerciser comprises an assisting tension means stretched between the motion means and the adjustable support arm at a position below the motion means.

19. The exercise device of claim 11 further comprising a means for resisting the exerciser in pulling the motion arm away from the exerciser.

20. The exercise device of claim 19 wherein the means for resisting the exerciser in pulling the motion arm away from the exerciser comprises a resisting tension means stretched between the motion means and the adjustable track arm at a position above the motion means.

* * * * *